US005876840A

United States Patent [19]

Ning et al.

[11] Patent Number: 5,876,840

[45] Date of Patent: Mar. 2, 1999

[54] CRIMP ENHANCEMENT ADDITIVE FOR MULTICOMPONENT FILAMENTS

[75] Inventors: Xin Ning; Samuel E. Marmon, both of Alpharetta, Ga.

[73] Assignee: Kimberly-Clark Worldwide, Inc., Neenah, Wis.

[21] Appl. No.: 940,286

[22] Filed: Sep. 30, 1997

[51] Int. Cl.[6] ..... B32B 27/18; B32B 27/32

[52] U.S. Cl. ..... 428/198; 428/372; 428/373; 442/335; 442/352; 442/353; 442/359; 442/364; 442/401; 442/409; 442/416

[58] Field of Search ..... 428/372, 373, 428/198; 442/335, 352, 353, 359, 364, 401, 409, 416

[56] References Cited

U.S. PATENT DOCUMENTS

| | | | |
|---|---|---|---|
| H1213 | 7/1993 | Hwo . | |
| H1419 | 2/1995 | Wilpers et al. . | |
| 3,247,300 | 4/1966 | Stump . | |
| 3,491,178 | 1/1970 | Nishioka et al. . | |
| 3,895,165 | 7/1975 | Lohwasser et al. . | |
| 3,917,784 | 11/1975 | Nishida . | |
| 4,013,753 | 3/1977 | Lohwasser et al. . | |
| 4,115,620 | 9/1978 | Gupta et al. . | |
| 4,189,338 | 2/1980 | Ejima et al. | 156/167 |
| 4,211,819 | 7/1980 | Kunimune et al. . | |
| 4,364,890 | 12/1982 | Treiber et al. . | |
| 4,451,589 | 5/1984 | Morman et al. . | |
| 4,477,516 | 10/1984 | Sugihara et al. . | |
| 4,596,742 | 6/1986 | Selivansky et al. . | |
| 4,632,861 | 12/1986 | Vassilatos . | |
| 4,783,231 | 11/1988 | Raley . | |
| 4,830,904 | 5/1989 | Gessner et al. . | |
| 4,840,846 | 6/1989 | Ejima et al. . | |
| 5,064,578 | 11/1991 | Insley et al. | 264/12 |
| 5,082,720 | 1/1992 | Hayes . | |
| 5,093,197 | 3/1992 | Howard et al. . | |
| 5,108,820 | 4/1992 | Kaneko et al. . | |
| 5,126,219 | 6/1992 | Howard et al. . | |
| 5,133,917 | 7/1992 | Jezic et al. . | |
| 5,165,979 | 11/1992 | Watkins et al. . | |
| 5,204,174 | 4/1993 | Daponte et al. . | |
| 5,209,984 | 5/1993 | Rolando et al. . | |
| 5,230,949 | 7/1993 | Howard et al. . | |
| 5,246,763 | 9/1993 | Murschall et al. . | |
| 5,266,392 | 11/1993 | Land et al. . | |
| 5,281,670 | 1/1994 | Lee et al. . | |
| 5,352,520 | 10/1994 | Kitajima et al. . | |
| 5,382,400 | 1/1995 | Pike et al. . | |
| 5,403,426 | 4/1995 | Johnson et al. . | |
| 5,418,045 | 5/1995 | Pike et al. . | |
| 5,424,115 | 6/1995 | Stokes . | |
| 5,455,110 | 10/1995 | Connor . | |
| 5,456,982 | 10/1995 | Hansen et al. . | |
| 5,460,884 | 10/1995 | Kobylivker et al. . | |
| 5,474,820 | 12/1995 | Murschall et al. . | |
| 5,482,772 | 1/1996 | Strack et al. . | |
| 5,489,454 | 2/1996 | Peiffer et al. . | |
| 5,492,757 | 2/1996 | Schumann et al. . | |
| 5,496,600 | 3/1996 | Peiffer et al. . | |
| 5,508,102 | 4/1996 | Georger et al. . | |
| 5,512,358 | 4/1996 | Shawver et al. . | |
| 5,516,563 | 5/1996 | Schumann et al. . | |
| 5,540,979 | 7/1996 | Yahiaoui et al. . | |
| 5,545,464 | 8/1996 | Stokes . | |
| 5,578,370 | 11/1996 | Ferrar et al. . | |
| 5,587,229 | 12/1996 | Clementini et al. . | |
| 5,597,647 | 1/1997 | Powers . | |
| 5,622,772 | 4/1997 | Stokes et al. . | |
| 5,652,051 | 7/1997 | Shawver et al. . | |

FOREIGN PATENT DOCUMENTS

| | | |
|---|---|---|
| 0518690A1 | 12/1992 | European Pat. Off. . |
| 4209913A1 | 9/1993 | Germany . |
| 68026335 | 11/1968 | Japan . |
| 70003886 | 2/1970 | Japan . |
| 7103815 | 1/1971 | Japan . |
| 4626895 | 8/1971 | Japan . |
| 72048189 | 12/1972 | Japan . |
| 56-140167 | 11/1981 | Japan . |
| 0173333A | 10/1984 | Japan . |
| 2184118A | 8/1987 | Japan . |
| 2299514A | 12/1987 | Japan . |
| 3105111 | 5/1988 | Japan . |
| 3243324 | 10/1988 | Japan . |
| 1266217 | 10/1989 | Japan . |
| 2091217A | 3/1990 | Japan . |
| 2139469A | 5/1990 | Japan . |
| 2191717A | 7/1990 | Japan . |
| 3161504A | 7/1991 | Japan . |
| 3167314A | 7/1991 | Japan . |
| 3193958A | 8/1991 | Japan . |
| 3241054A | 10/1991 | Japan . |
| 3241055A | 10/1991 | Japan . |
| 3287818A | 12/1991 | Japan . |
| 5147179A | 6/1993 | Japan . |
| 5192240A | 8/1993 | Japan . |
| 5311516A | 11/1993 | Japan . |
| 896955 | 5/1962 | United Kingdom . |
| 1343449 | 1/1974 | United Kingdom . |

*Primary Examiner*—Marion McCamish
*Assistant Examiner*—Ula C. Ruddock
*Attorney, Agent, or Firm*—Dority & Manning, P.A.

[57] ABSTRACT

Spunbond multicomponent filaments and nonwoven webs made from the filaments are disclosed. In accordance with the present invention, the multicomponent filaments contain a crimp enhancement additive. Specifically, the crimp enhancement additive is added to one of the polymeric components in order to accelerate its solidification rate. The additive enhances crimp, allows for highly crimped filaments to be made at smaller deniers, and produces low density webs with improved stretch and cloth-like properties. Specifically, the additive incorporated into the filaments is a nonionic surfactant such as an alkyl ether alkoxylate, a siloxane alkoxylate, an ester of a polyalkylene glycol, a polysaccharide derivative, a glycerol ester, or mixtures thereof.

30 Claims, 2 Drawing Sheets

CRIMP ENHANCEMENT ADDITIVE FOR MULTICOMPONENT FILAMENTS

FIELD OF THE INVENTION

The present invention is generally directed to spunbond multicomponent filaments and to nonwoven webs made from the filaments. More particularly, the present invention is directed to incorporating an additive into one of the polymers used to make multicomponent filaments. The additive enhances crimp, allows for smaller deniers, generally simplifies the process for naturally crimping the filaments, and produces webs with improved stretch and cloth-like properties. In particular, the additive incorporated into the filaments is a nonionic surfactant.

BACKGROUND OF THE INVENTION

Nonwoven fabrics are used to make a variety of products which desirably have particular levels of softness, strength, uniformity, liquid handling properties such as absorbency, and other physical properties. Such products include towels, industrial wipers, incontinence products, filter products, infant care products such as baby diapers, absorbent feminine care products, and garments such as medical apparel. These products are often made with multiple layers of nonwoven fabrics to obtain the desired combination of properties. For example, disposable baby diapers made from polymeric nonwoven fabrics may include a soft and porous liner layer which fits next to the baby's skin, an impervious outer cover layer which is strong and soft, and one or more interior liquid handling layers which are soft, bulky and absorbent.

Nonwoven fabrics such as the foregoing are commonly made by melt spinning thermoplastic materials. Such fabrics are called spunbond materials. Spunbond nonwoven polymeric webs are typically made from thermoplastic materials by extruding the thermoplastic material through a spinneret and drawing the extruded material into filaments with a stream of high velocity air to form a random web on a collecting surface.

Spunbond materials with desirable combinations of physical properties, especially combinations of softness, strength and absorbency, have been produced, but limitations have been encountered. For example, for some applications, polymeric materials such as polypropylene may have a desirable level of strength but not a desirable level of softness. On the other hand, materials such as polyethylene may, in some cases, have a desirable level of softness but not a desirable level of strength.

In an effort to produce nonwoven materials having desirable combinations of physical properties, nonwoven polymeric fabrics made from multicomponent or bicomponent filaments and fibers have been developed. Bicomponent or multicomponent polymeric fibers or filaments include two or more polymeric components which remain distinct. As used herein, filaments mean continuous strands of material and fibers mean cut or discontinuous strands having a definite length. The first and subsequent components of multicomponent filaments are arranged in substantially distinct zones across the cross-section of the filaments and extend continuously along the length of the filaments. Typically, one component exhibits different properties than the other so that the filaments exhibit properties of the two components. For example, one component may be polypropylene which is relatively strong and the other component may be polyethylene which is relatively soft. The end result is a strong yet soft nonwoven fabric.

To increase the bulk or fullness of the bicomponent nonwoven webs for improved fluid management performance or for enhanced "cloth-like" feel of the webs, the bicomponent filaments or fibers are often crimped. Bicomponent filaments may be either mechanically crimped or, if the appropriate polymers are used, naturally crimped. As used herein, a naturally crimped filament is a filament that is crimped by activating a latent crimp contained in the filaments. For instance, in one embodiment, filaments can be naturally crimped by subjecting the filaments to a gas, such as a heated gas, after being drawn.

In general, it is far more preferable to construct filaments that can be naturally crimped as opposed to having to crimp the filaments in a separate mechanical process. Difficulties have been experienced in the past, however, in producing filaments that will crimp naturally to the extent required for the particular application.

Also, in the past, it was generally necessary to naturally crimp multicomponent filaments by contacting the filaments with heated air. In particular, it was typically necessary to heat the air to temperatures as high as 350° F. in order to activate any latent crimp present within the filaments. Unfortunately, heating a gas to such high temperatures substantially increases the energy requirements of the process. It would be particularly desirable if multicomponent filaments could be naturally crimped without having to be exposed to a heated gas stream.

As such, currently a need exists for a method of producing multicomponent filaments with enhanced natural crimp properties. Also, a need exists for nonwoven webs made from such filaments.

SUMMARY OF THE INVENTION

The present invention recognizes and addresses the foregoing disadvantages, and others of prior art constructions and methods.

Accordingly, an object of the present invention is to provide improved nonwoven fabrics and methods for making the same.

Another object of the present invention is to provide nonwoven polymeric fabrics including highly crimped filaments and methods for economically making the same.

A further object of the present invention is to provide a method for controlling the properties of a nonwoven polymeric fabric by varying the degree of crimp of filaments and fibers used to make the fabric.

Another object of the present invention is to provide an improved process for naturally crimping multicomponent filaments.

It is another object of the present invention to provide a method for naturally crimping multicomponent filaments by adding to one of the components of the filaments a crimp enhancement additive.

It is still another object of the present invention to provide a process for producing multicomponent crimped filaments in which a nonionic surfactant has been added to one of the polymeric components used to make the filaments.

Another object of the present invention is to provide a process for naturally crimping multicomponent filaments by exposing the filaments to a gas at ambient temperature.

These and other objects of the present invention are achieved by providing a process for forming a nonwoven web. The process includes the steps of melt spinning multicomponent filaments. The multicomponent filaments include a first polymeric component and a second polymeric component. The first polymeric component has a faster solidification rate than the second polymeric component for providing the filaments with a latent crimp. In accordance with the present invention, the first polymeric component contains a crimp enhancement additive. In particular, the crimp enhancement additive is a nonionic surfactant.

Once melt spun, the multicomponent filaments are drawn and naturally crimped. Thereafter, the crimped filaments are formed into a nonwoven web for use in various applications.

In one embodiment, the crimp enhancement additive can be, for instance, an ether of a fatty alcohol. As used herein, a fatty alcohol refers to an alcohol having a carbon chain of 20 carbon atoms or less, and particularly a carbon chain of 10 carbon atoms or less. For example, an ether of a fatty alcohol can include an alkyl ether alkoxylate.

Other nonionic surfactants that may be used in the present invention include siloxane alkoxylates and esters of polyalkylene glycols, such as fatty acid esters of polyethylene glycol or polypropylene glycol. One particular example of an ester of a polyalkylene glycol particularly well suited for use in the present invention is polyethylene glycol monolaurate.

Further examples of nonionic surfactants include glycerol esters and polysaccharide derivatives. For instance, in one embodiment, the crimp enhancement additive can be a mixture of sorbitan monooleate and an alkoxylated castor oil, such as a polyethoxylated hydrogenated castor oil.

Preferably, the first polymeric component is polypropylene or a copolymer containing primarily polypropylene. The second polymeric component, on the other hand, can be polypropylene, copolymers of polypropylene, polyethylene, and copolymers of polyethylene.

In general, the crimp enhancement additive of the present invention can be added to the first polymeric component in an amount up to about 5% by weight, and particularly from about 0.5% to about 5% by weight. In one preferred embodiment, the crimp enhancement additive is added to the first polymeric component in an amount from about 1.5% to about 3.5% by weight.

Once present, the crimp enhancement additive causes the filaments to undergo a greater degree of natural crimping. For instance, filaments made according to the present invention will typically have at least 10 crimps per inch, and particularly from about 15 crimps per inch to about 25 crimps per inch of particular advantage, as opposed to prior art constructions, the filaments of the present invention can be naturally crimped without subjecting the filaments to a heated gas. Instead, the latent crimp present within the filaments can be activated simply by contacting the filaments with air at ambient temperature during formation.

These and other objects of the present invention are also achieved by providing a nonwoven web made from spunbond multicomponent, crimped filaments. The multicomponent crimped filaments are made from at least a first polymeric component and a second polymeric component. In particular, the polymeric components are selected such that the first polymeric component has a faster solidification rate than the second polymeric component. In accordance with the present invention, the first polymeric component contains a crimp enhancement additive which comprises a nonionic surfactant.

For instance, in one embodiment, the crimped filaments can be bicomponent filaments which include a polypropylene component and either a second polypropylene component or a polyethylene component. The nonionic surfactant can be added to the polypropylene component in an amount up to about 5% by weight. The nonionic surfactant can be, for instance, an alkyl ether alkoxylate, a siloxane alkoxylate, an ester of a polyalkylene glycol, a glycerol ester, a polysaccharide derivative, or mixtures thereof.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
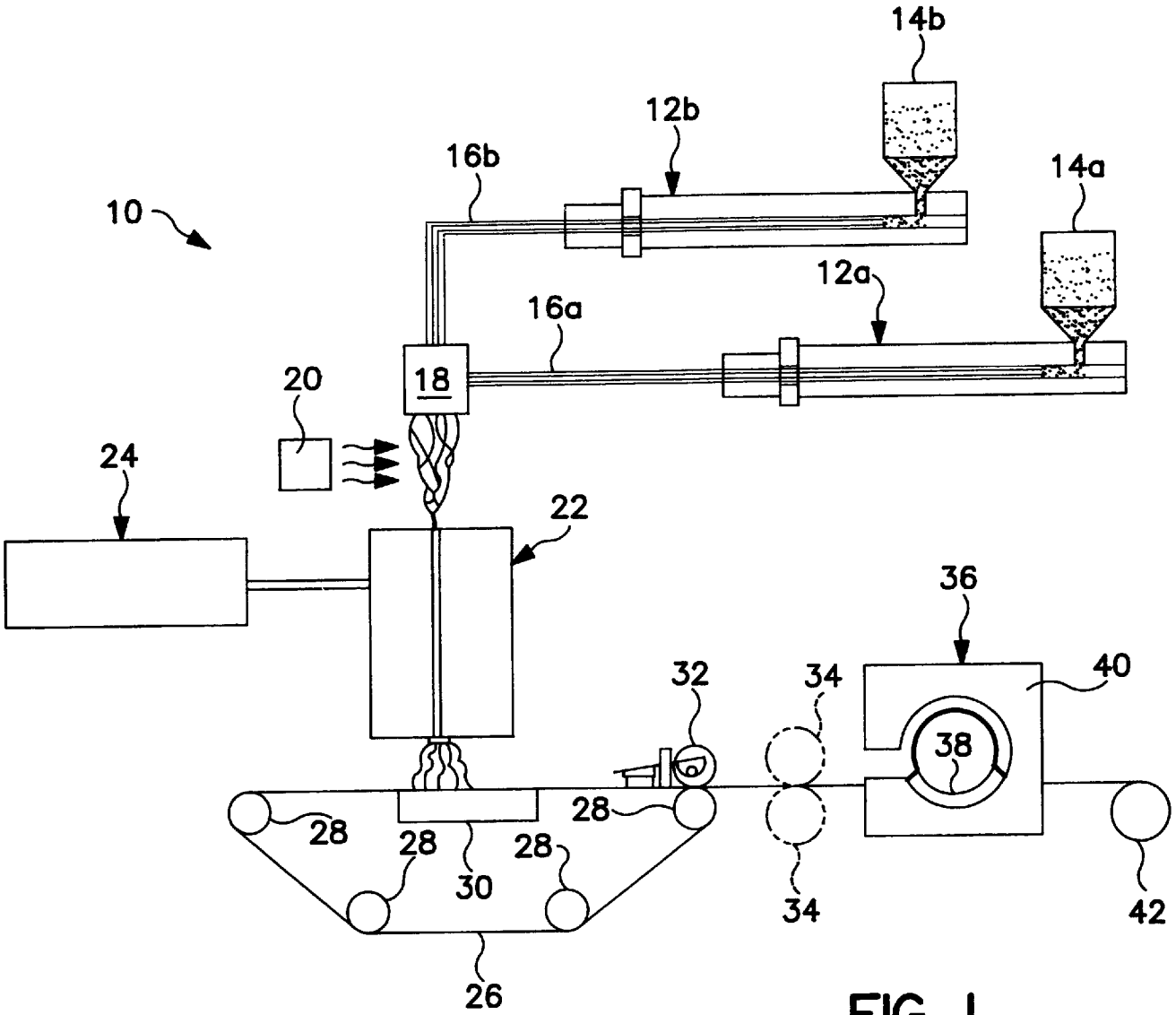
FIG. 1 is a schematic drawing of a process line for making a preferred embodiment of the present invention.

Repeat use of reference characters in the present specification and drawings is intended to represent same or analogous features or elements of the invention.

DETAILED DESCRIPTION OF THE PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

The present invention is generally directed to multicomponent filaments and to spunbond webs produced from the filaments. In particular, the filaments are naturally crimped into, for instance, a helical arrangement. Crimping the filaments increases the bulk, the softness, the drapability, and can increase the strength of nonwoven webs made from the filaments. The nonwoven webs also have improved fluid management properties and have an enhanced cloth-like appearance and feel.

Multicomponent filaments for use in the present invention contain at least two polymeric components. The polymeric components can be, for instance, in a side-by-side configuration or in an eccentric sheath-core configuration. The polymeric components are selected from semi-crystalline and crystalline thermoplastic polymers which have different solidification rates with respect to each other in order for the filaments to undergo natural crimping. More particularly, one of the polymeric components has a faster solidifying rate than the other polymeric component.

As used herein, the solidification rate of a polymer refers to the rate at which a softened or melted polymer hardens and forms a fixed structure. It is believed that the solidification rate of a polymer is influenced by different parameters including the melting temperature and the rate of crystallization of the polymer. For instance, a fast solidifying polymer typically has a melting point that is about 10° C. or higher, more desirably about 20° C. or higher, and most desirably about 30° C. or higher than a polymer that has a slower solidifying rate. It should be understood, however, that both polymeric components may have similar melting points if their crystallization rates are measurably different.

Although unknown, it is believed that the latent crimpability of multicomponent filaments is created in the filaments due to the differences in the shrinkage properties between the polymeric components. Further, it is believed that the main cause of the shrinkage difference between polymeric components is the incomplete crystallization of the slower solidifying polymer during the fiber production process. For instance, during formation of the filaments, when the fast solidifying polymer is solidified, the slow solidifying polymer is partially solidified and does not measurably draw any longer and thus does not further experience a significant orienting force. In the absence of an orienting force, the slow solidified polymer does not significantly further crystallize while being cooled and solidified. Accordingly, the resulting filaments possess latent crimpability, and such latent crimpability can be activated by subjecting the filaments to a process that allows sufficient molecular movement of the polymer molecules of the slow solidifying polymer to facilitate further crystallization and shrinkage.

The present invention is directed to adding a crimp enhancement additive to one of the polymeric components contained in a multicomponent filament. The crimp enhancement additive creates a greater amount of natural crimping potential within the filament by creating or increasing the difference in the solidification rates between the polymeric components. In particular, it has been discovered that the crimp enhancement additive of the present invention, when combined with a polymer, causes the solidification rate of the polymer to accelerate.

For example, in one embodiment, bicomponent filaments can be constructed containing a polypropylene component and a polyethylene component. It is generally known that the polypropylene component will have a faster solidification rate than the polyethylene component. In accordance with the present invention, the crimp enhancement additive can be added to the polypropylene component therefore further accelerating the solidification rate of the polypropylene. In this manner, the difference between the solidification rates of the polypropylene and the polyethylene become even greater creating filaments that have an enhanced latent crimpability.

Besides creating a greater differential between the solidification rates of two polymeric components, the crimp enhancement additive of the present invention can also be used to create latent crimp in a filament that is made from two or more polymeric components that all have the same or similar solidification rates. For instance, in one alternative embodiment, the additive can be added to a bicomponent filament in which the first polymeric component and the second polymeric component are made from the same polymer. For instance, in a bicomponent filament containing a first polymeric component made from polypropylene and a second polymeric component also made from polypropylene, the crimp enhancement additive of the present invention can be combined with one of the components. When added to one of the polymeric components, the solidification rate of the polymeric component increases, creating a solidification rate differential with the other polymeric component, thereby creating latent crimpability within the filament. Through this method, multicomponent filaments made exclusively from polymeric components that all have similar solidification rates can be naturally crimped instead of having to be crimped mechanically.

The crimp enhancement additive of the present invention, which has been found to increase the solidification rates of polymeric materials and which also has been found to be particularly well suited for use in spunbond processes, is generally directed to nonionic surfactants or to a blend of nonionic surfactants that are compatible with the polymer melt. For instance, examples of nonionic surfactants include ethers of fatty alcohols, siloxane alkoxylates, esters of polyalkylene glycols, glycerol esters, polysaccharide derivatives, and mixtures thereof.

For instance, examples of ethers of fatty alcohols particularly include alkyl ether alkoxylates, such as alkyl ether ethoxylates and alkyl ether propoxylates. One commercially available alkyl ether alkoxylate that may be used in the process of the present invention is ANTAROX BL-214 surfactant marketed by Rhone-Poulenc of Cranbury, N.J. ANTAROX BL-214 surfactant is a mixture of ethoxylated and propoxylated C8 to C10 alcohols.

A siloxane alkoxylate is a silicone surfactant that includes ethoxylated siloxanes and propoxylated siloxanes. One example of a commercially available silicone surfactant that may be used as the crimp enhancement additive of the present invention is MASIL SF 19 surfactant marketed by PPG Industries, Inc. of Gurnee, Ill.

Another class of compounds that may be used as the crimp enhancement additive of the present invention include esters of polyalkylene glycols, and particularly fatty acid esters of polyethylene glycol and polypropylene glycol. For example, the fatty acids that may be combined with the polyalkylene glycols include lauric acid, palmitic acid, stearic acid, and the like. For instance, one commercially available fatty acid ester of a polyalkylene glycol is MAPEG 400 ML marketed by PPG Industries, Inc. of Gurnee, Ill. MAPEG 400 ML is a polyethylene glycol monolaurate. Specifically, although not critical to the present invention, MAPEG 400 ML is made with a polyethylene glycol having a molecular weight of about 400.

Other nonionic surfactants that may be used in the present invention include polysaccharide derivatives and glycerol esters. An example of a polysaccharide derivative, for instance, is sorbitan monooleate, while a glycerol ester can include, for instance, an alkoxylated castor oil. One commercially available nonionic surfactant that contains a mixture of sorbitan monooleate and a polyethoxylated hydrogenated castor oil is AHCOVEL BASE N-62 marketed by ICI Americas, Inc. of Wilmington, Del.

As described above, it has been discovered that the above nonionic surfactants, when combined with a polymeric material, increase the solidification rate of the polymer. When added to multicomponent filaments, the crimp enhancement additive of the present invention can be used to either create latent crimp in a filament made from polymers having similar solidification rates or can be used to create greater amounts of latent crimp in a filament made from polymers that already have different solidification rates.

Besides creating multicomponent filaments that have a greater natural crimp, it has also been discovered that the crimp enhancement additive of the present invention provides many other benefits and advantages. For instance, because the filaments of the present invention have a greater degree of crimping, fabrics and webs made from the filaments have a higher bulk and a lower density. By being able to make lower density webs, less material is needed to make the webs and the webs are thus less expensive to produce. Besides having lower densities, the webs have also been found to be more cloth-like, to have a softer hand, to have more stretch, to have better recovery, and to have better abrasion resistance.

A further advantage to the crimp enhancement additive of the present invention is that the additive permits the formation of multicomponent filaments having a relatively high natural crimp while at the same time having a relatively low denier. As used herein, denier refers to the linear density of a filament. In the past, it was very difficult to create filaments at low linear densities or deniers, such as less than 2, that had a relatively high natural crimp. In the past, the draw force used to produce low denier fibers usually prevented or removed any meaningful latent crimp present within the filaments. Filaments made according to the present invention, on the other hand, can have greater than 10 crimps per inch at deniers lower than 2, and even lower than 1.2.

As described above, the fabric of the present invention includes continuous multicomponent polymeric filaments comprising at least first and second polymeric components. A preferred embodiment of the present invention is a polymeric fabric including continuous bicomponent filaments comprising a first polymeric component A and a second polymeric component B. The bicomponent filaments have a cross-section, a length, and a peripheral surface. The first and second components A and B are arranged in substantially distinct zones across the cross-section of the bicomponent filaments and extend continuously along the length of the bicomponents filaments. The second component B constitutes at least a portion of the peripheral surface of the bicomponent filaments continuously along the length of the bicomponent filaments.

Figure 2A:
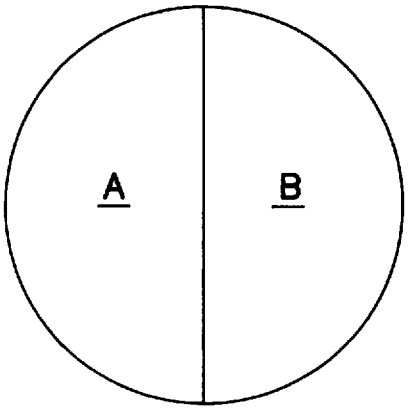
FIG. 2A is a schematic drawing illustrating the cross section of a filament made according to an embodiment of the present invention with the polymer components A and B in a side-by-side arrangement.
Figure 2B:
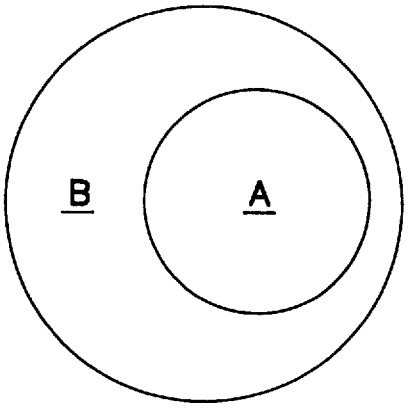
FIG. 2B is a schematic drawing illustrating the cross section of a filament made according to an embodiment of the present invention with the polymer components A and B in a eccentric sheath/core arrangement.

The first and second components A and B are arranged in either a side-by-side arrangement as shown in FIG. 2A or an eccentric sheath/core arrangement as shown in FIG. 2B so that the resulting filaments exhibit a natural helical crimp. Polymer component A is the core of the filament and polymer component B is the sheath in the sheath/core arrangement. Methods for extruding multicomponent polymeric filaments into such arrangements are well-known to those of ordinary skill in the art.

A wide variety of polymers are suitable to practice the present invention. Preferably the polymers chosen to construct filaments in accordance with the present invention are polyolefins, such as polyethylene and polypropylene. For most applications, the crimp enhancement additive of the present invention is added to polymer component A as described above. Further, it has also been found that the crimp enhancement additive should be added to polypropylene or a copolymer containing polypropylene.

Thus, in one embodiment, polymer component A can comprise polypropylene or a random copolymer containing polypropylene, such as a copolymer of propylene and butylene.

Polymer component B, on the other hand, preferably comprises polyethylene such as linear low density polyethylene and high density polyethylene, polypropylene, or a random copolymer of propylene and ethylene. Of particular advantage, polymer component A and polymer component B can be made from the same polypropylene polymer and, by adding the crimp enhancement additive to one of the components, a filament can be formed having a natural crimp.

Suitable materials for preparing the multicomponent filaments of the present invention include ESCORENE PD-3445 polypropylene available from Exxon of Houston, Tex., random copolymer of propylene and ethylene available from Exxon, ASPUN 6811A, XU 61800, and 2553 polyethylene available from the Dow Chemical Company of Midland, Mich., 25355 and 12350 high density polyethylene available from the Dow Chemical Company.

When polypropylene is component A and polyethylene or polypropylene is component B, the bicomponent filaments may comprise from about 20 to about 80% by weight component A and from about 20 to about 80% component B. More preferably, the filaments comprise from about 40 to about 60% by weight component A and from about 40 to about 60% by weight component B.

In order to combine the crimp enhancement additive with a polymer component, in one embodiment, the polymer and the additive can be blended and extruded together during formation of the multicomponent filaments. In an alternative embodiment, the crimp enhancement additive and polymer component can be melt blended prior to being formed into the filaments of the present invention. For instance, the polymer component and additive can be extruded through a twin screw extruder and formed into pellets prior to being melt spun into filaments. Compounding the polymer component with the crimp enhancement additive prior to formation of the filaments as described above may promote better mixing between the ingredients.

In general, the crimp enhancement additive can be added to one of the polymeric components in an amount up to about 5% by weight. In particular, in one preferred embodiment, the crimp enhancement additive can be added to polymeric component A above in an amount of from about 0.5% to a about 5% by weight, and particularly from about 1.5% to about 3.5% by weight. Should too much of the additive be combined with a polymer, the viscosity of the polymer may increase to the point where the polymer can not be effectively spun into filaments and filament breakage may occur.

One process for producing multicomponent filaments and nonwoven webs according to the present invention will now be discussed in detail with reference to FIG. 1. The following process is similar to the process described in U.S. Pat. No. 5,382,400 to Pike et al., which is incorporated herein by reference in its entirety.

Turning to FIG. 1, a process line 10 for preparing a preferred embodiment of the present invention is disclosed. The process line 10 is arranged to produce bicomponent continuous filaments, but it should be understood that the present invention comprehends nonwoven fabrics made with multicomponent filaments having more than two components. For example, the fabric of the present invention can be made with filaments having three or four components.

The process line 10 includes a pair of extruders 12*a* and 12*b* for separately extruding a polymer component A and a polymer component B. Polymer component A is fed into the respective extruder 12*a* from a first hopper 14*a* and polymer component B is fed into the respective extruder 12*b* from a second hopper 14*b*. Polymer components A and B are fed from the extruders 12*a* and 12*b* through respective polymer conduits 16*a* and 16*b* to a spinneret 18.

Spinnerets for extruding bicomponent filaments are well-known to those of ordinary skill in the art and thus are not described here in detail. Generally described, the spinneret 18 includes a housing containing a spin pack which includes a plurality of plates stacked one on top of the other with a pattern of openings arranged to create flow paths for directing polymer components A and B separately through the spinneret. The spinneret 18 has openings arranged in one or more rows. The spinneret openings form a downwardly extending curtain of filaments when the polymers are extruded through the spinneret. For the purposes of the present invention, spinneret 18 may be arranged to form side-by-side or eccentric sheath/core bicomponent filaments illustrated in FIGS. 2A and 2B.

The process line 10 also includes a quench blower 20 positioned adjacent the curtain of filaments extending from the spinneret 18. Air from the quench air blower 20 quenches the filaments extending from the spinneret 18. The quench air can be directed from one side of the filament curtain as shown FIG. 1, or both sides of the filament curtain.

A fiber draw unit or aspirator 22 is positioned below the spinneret 18 and receives the quenched filaments. Fiber draw units or aspirators for use in melt spinning polymers are well-known as discussed above. Suitable fiber draw units for use in the process of the present invention include a linear fiber aspirator of the type shown in U.S. Pat. No. 3,802,817 and educative guns of the type shown in U.S. Pat. Nos. 3,692,618 and 3,423,266, the disclosures of which are incorporated herein by reference.

Generally described, the fiber draw unit 22 includes an elongate vertical passage through which the filaments are drawn by aspirating air entering from the sides of the passage and flowing downwardly through the passage. A heater or blower 24 supplies aspirating air to the fiber draw unit 22. The aspirating air draws the filaments and ambient air through the fiber draw unit.

An endless foraminous forming surface 26 is positioned below the fiber draw unit 22 and receives the continuous filaments from the outlet opening of the fiber draw unit. The forming surface 26 travels around guide rollers 28. A vacuum 30 positioned below the forming surface 26 where the filaments are deposited draws the filaments against the forming surface.

The process line 10 further includes a bonding apparatus such as thermal point bonding rollers 34 (shown in phantom) or a through-air bonder 36. Thermal point bonders and through-air bonders are well-known to those skilled in the art and are not disclosed here in detail. Generally described, the through-air bonder 36 includes a perforated roller 38, which receives the web, and a hood 40 surrounding the perforated roller. Lastly, the process line 10 includes a winding roll 42 for taking up the finished fabric.

To operate the process line 10, the hoppers 14*a* and 14*b* are filled with the respective polymer components A and B. Polymer components A and B are melted and extruded by the respective extruders 12*a* and 12*b* through polymer conduits 16*a* and 16*b* and the spinneret 18. In accordance with the present invention, polymer component A preferably contains the crimp enhancement additive of the present invention. As described above, the additive can be blended with the polymer as it is fed through extruder 12*a* or the polymer can be premixed with the additive. Although the temperatures of the molten polymers vary depending on the polymers used, when polypropylene or polyethylene are used as the components, the preferred temperatures of the polymers when extruded range from about 370° to about 530° F. and preferably range from 400° to about 450° F.

As the extruded filaments extend below the spinneret 18, a stream of air from the quench blower 20 at least partially quenches the filaments to develop a latent helical crimp in the filaments. The quench air preferably flows in a direction substantially perpendicular to the length of the filaments at a temperature of about 45° to about 90° F. and a velocity of from about 100 to about 400 feet per minute.

After quenching, the filaments are drawn into the vertical passage of the fiber draw unit 22 by a flow of a gas, such as air, from the heater or blower 24 through the fiber draw unit. The fiber draw unit is preferably positioned 30 to 60 inches below the bottom of the spinneret 18.

In the past, in order to activate the latent crimp of a filament, the temperature of the air supplied from heater 24 had to be heated to temperatures generally greater than 170° F. and particularly to temperatures of around 350° F. It has been unexpectedly discovered, however, that by adding the crimp enhancement additive of the present invention to a multicomponent filament, it is no longer necessary to contact the filament with a heated gas stream in order for the filament to naturally crimp. Instead, it has been discovered that the latent crimp of filaments constructed in accordance with the present invention can be activated merely by contacting the filaments with a gas stream, such as air, at ambient temperature, such as temperatures as low as about 60° F. or even lower. Thus, when processing filaments containing the crimp enhancement additive, heater 24 is no longer required and the energy requirements for producing the crimped filaments is substantially reduced.

If desired, however, the air contacting the filaments may still be heated. Under some applications, if the air is heated, although not necessary, a greater degree of crimping may occur. In this regard, the temperature of the air from the heater 24 can be varied in order to achieve different levels of crimp.

The ability to control the degree of crimp of the filaments is particularly advantageous because it allows one to change the resulting density, pore size distribution and drape of the fabric by simply adjusting the temperature of the air in the fiber draw unit.

The crimped filaments are deposited through the outlet opening of the fiber draw unit 22 onto the traveling forming surface 26. The vacuum 20 draws the filaments against the forming surface 26 to form an unbonded, nonwoven web of continuous filaments. If necessary, the web is then lightly compressed by a compression roller 32 and then thermal point bonded by rollers 34 or through-air bonded in the through-air bonder 36.

In the through-air bonder 36 as shown in FIG. 1, air having a temperature above the melting temperature of component B and equal to or below the melting-temperature of component A is directed from the hood 40, through the web, and into the perforated roller 38. The hot air melts the polymer component B and thereby forms bonds between the bicomponent filaments to integrate the web. When polypropylene and polyethylene are used as polymer components, the air flowing through the through-air bonder preferably has a temperature ranging from about 230° to about 280° F. and a velocity from about 100 to about 500 feet per minute. The dwell time of the web in the through-air bonder is preferably less than about 6 seconds. It should be understood, however, that the parameters of the through-air bonder depend on factors such as the type of polymers used and thickness of the web.

Lastly, the finished web is wound onto the winding roller 42 and is ready for further treatment or use. When used to make liquid absorbent articles, the fabric of the present invention may be treated with conventional surface treatments or contain conventional polymer additives to enhance the wettability of the fabric. For example, the fabric of the present invention may be treated with polyalkylene-oxide modified siloxanes and silanes such as polyalkylene-oxide modified polydimethyl-siloxane as disclosed in U.S. Pat. No. 5,057,361. Such a surface treatment enhances the wettability of the fabric.

With the present invention, however, it has been discovered that the surfactant additive also serves as a wetting agent for the bonded web. Thus, the web becomes naturally wettable to aqueous liquids. Therefore, a post-treatment may not be necessary. Furthermore, if such post-treatment is desired, the wetting characteristics of the original web will facilitate the post-treatment process.

When through-air bonded, the fabric of the present invention characteristically has a relatively high loft. The helical crimp of the filaments creates an open web structure with substantial void portions between filaments and the filaments are bonded at points of contact. The through-air bonded web of the present invention typically has a density of from about 0.015 g/cc to about 0.040 g/cc and a basis weight of from about 0.25 to about 5 oz. per square yard and more preferably from about 1.0 to about 3.5 oz. per square yard.

Filament denier generally ranges from less than 1.0 to about 8 dpf. As discussed above, the crimp enhancement additive of the present invention generally allows for the production of highly crimped, low denier filaments. In the past, naturally crimped low denier filaments were difficult if not impossible to produce. According to the present invention, filaments having a natural crimp of at least about 10 crimps per inch can be produced at deniers less than 2, and particularly at deniers less than about 1.5. For most nonwoven webs, it is preferable for the filaments to have from about 10 crimps per inch to about 25 crimps per inch.

Thermal point bonding may be conducted in accordance with U.S. Pat. No. 3,855,046, the disclosure of which is incorporated herein by reference. When thermal point bonded, the fabric of the present invention exhibits a more cloth-like appearance and, for example, is useful as an outer cover for personal care articles or as a garment material.

Although the methods of bonding shown in FIG. 1 are thermal point bonding and through-air bonding, it should be understood that the fabric of the present invention may be bonded by other means such as oven bonding, ultrasonic bonding, hydroentangling or combinations thereof. Such bonding techniques are well-known to those of ordinary skill in the art and are not discussed here in detail.

Although, the preferred method of carrying out the present invention includes contacting the multicomponent filaments with aspirating air, the present invention encompasses other methods of activating the latent helical crimp of the continuous filaments before the filaments are formed into a web. For example, the multicomponent filaments may be contacted with air after quenching but upstream of the aspirator. In addition, the multicomponent filaments may be contacted with air between the aspirator and the web forming surface. Furthermore, the filaments may also be exposed to electromagnetic energy such as microwaves or infrared radiation.

Once produced, the nonwoven webs of the present invention can be used in many different and various applications. For instance, the webs can be used in filter products, in liquid absorbent products, in personal care articles, in garments, and in various other products.

The present invention may be better understood with reference to the following examples.

EXAMPLE NO. 1

A spunbond bicomponent filament web having a basis weight of 2.6 ounces per square yard was produced according to the process described in U.S. Pat. No. 5,382,400 to Pike, et al. The bicomponent filaments used to make the web included a polyethylene component and a polypropylene component in a side by side configuration. The polyethylene used to make the filaments was ASPUN XU61800 obtained from Dow Chemical.

The polypropylene used to make the filaments, on the other hand, was ESCORENE 3445 obtained from the Exxon Corporation and contained 2% by weight $TiO_2$. In accordance with the present invention, the polypropylene also contained 2.5% by weight MASIL SF-19 nonionic siloxane ethoxylate surfactant obtained from PPG Industries. The nonionic surfactant was added to the polypropylene in accordance with the present invention to act as a crimp enhancement additive.

The polypropylene component and the polyethylene component were fed into separate extruders. The extruded polymers were spun into round bicomponent filaments using a spinning die having 50 holes per inch.

From the spinning die, the filaments were fed through a fiber draw unit at a draw pressure of 3.5 psi and a throughput of 0.5 ghm. The resulting filaments had a denier of 2.1 dpf. The fibers were drawn by air at 3.5 psi and 65° F. Of particular advantage, while the filaments were being drawn, the air at a temperature of only 65° F. activated the latent crimp and caused the filaments to become highly crimped.

The drawn filaments were deposited onto a foraminous surface to form a nonwoven web which was passed through a through-air bonder at a temperature of 255° F. The resulting fabric had a density of 0.024 grams per cubic centimeter and was found to be instantly wettable to water.

A similar process was also used to form bicomponent filaments that did not contain the crimp enhancement additive of the present invention. Such filaments did not achieve any crimp when contacted with air at the fiber draw unit at about the same temperature as described above. Further, the web made from the filaments did not have as much loft as the above fabric made according to the present invention.

EXAMPLE NO. 2

The process for making bicomponent filaments and for making a nonwoven web from the filaments as described in Example No. 1 was repeated. In this example, however, instead of using MASIL SF-19 nonionic surfactant, ANTAROX BL-214 obtained from Rhone-Poulenc was used. ANTAROX BL-214, which is an alkyl ether ethoxylate, was added to the polypropylene component in an amount of 3% by weight.

During the process, the fiber draw pressure was 3 psi, the polymer through-put was 0.5 ghm and the through-air bonder temperature was 250° F. During drawing, the filaments were contacted with air at a temperature of only about 54° F. in order to crimp the filaments. The filaments were drawn to a denier size of about 2.2.

The resulting fabric had a basis weight of 3.5 ounces per square yard and a density of 0.020 grams per cubic centimeter.

Similar to the fabric made in Example 1, the nonwoven web made with ANTAROX BL-214 was found to have a high loft and was instantly wettable to water. It was also observed that the bicomponent filaments became highly crimped when subjected to air at a temperature of only 54° F. Thus, this example further demonstrates that heated air is not needed to activate the latent crimp present within of the filaments.

EXAMPLE NO. 3

The process described in Example 2 was repeated. In particular, the polypropylene component again contained 3% by weight ANTAROX BL-214 nonionic surfactant. As opposed to Example No. 2, however, the through-put of the polymer through the spin pack was 0.4 ghm.

In this example, the filaments had a denier of 1.7, while the resulting fabric had a basis weight of 3.1 ounces per square yard and a density of 0.021 grams per cubic centimeter. Again, a nonwoven web was produced with a substantial amount of loft and that was instantly wettable to water. In this example, it was also discovered that low denier filaments could be produced according to the present invention that could be highly crimped merely by subjecting the filaments to air at about ambient temperature.

EXAMPLE NO. 4

The procedure for producing filaments and nonwoven webs described in Example No. 1 was repeated. In this example, instead of using MASIL SF-19 nonionic surfactant, a mixture of MAPEG 400 ML obtained from PPG Industries and ANTAROX BL-214 were added to the polypropylene component in an amount of 3% by weight and in a weight ratio of 1:1. MAPEG 400 ML contains polyethylene glycol monolaurate.

The polymer filaments were drawn at a through-put of 0.5 ghm and at a pressure of 2 psi.

The filaments produced had a denier of approximately 2.3. During the drawing process, the filaments were subjected to ambient air in order to activate the latent crimp. The filaments became highly crimped during the process.

The nonwoven web made from the filaments had a density of about 0.025 grams per cubic centimeter. It was observed that the nonwoven web had high loft.

EXAMPLE NO. 5

The process for producing filaments and webs described in Example No. 4 above was repeated using, in this example, as a crimp enhancement additive, a mixture of AHCOVEL Base N-62 obtained from ICI Americas, Inc., which is a mixture of sorbitan monooleate and polyethoxylated hydrogenated castor oil, and ANTAROX BL-214. The mixture was added to the polypropylene component in an amount of 3% by weight. The AHCOVEL Base N-62 and ANTAROX BL-214 were added in equal proportions.

In order to crimp the filaments, the filaments were contacted with air at a temperature of approximately 64° F. while being drawn. Upon contact with the air, the filaments became highly crimped. The filaments produced had a denier of approximately 2.3.

The nonwoven web spun from the filaments had a density of 0.030 grams per cubic centimeter and contained a substantial amount of loft.

EXAMPLE NO. 6

The following example was conducted in order to demonstrate that besides polypropylene/polyethylene filaments, the crimp enhancement additive of the present invention can also be used in polypropylene/polypropylene filaments.

Polypropylene/polypropylene bicomponent filaments were made similar to the process described in Example No. 1. Specifically, the bicomponent filaments were made from polypropylene containing 2% by weight $TiO_2$. In accordance with the present invention, added to one side of the filament in an amount of 3% by weight was ANTAROX BL-214 alkyl ether ethoxylate nonionic surfactant.

Side-by-side filaments were produced using a 20 hole fiber spin pack. The polymer through-put through the spin pack was 0.35 ghm. The filaments were drawn at a pressure dial reading of 75 using a Lurgi Gun. During drawing, the filaments were contacted with air at ambient temperature which caused the filaments to crimp. High loft, loose webs were obtained from the filaments.

Polypropylene/polypropylene bicomponent filaments were also similarly produced that did not contain the ANTAROX nonionic surfactant. As opposed to the above-described filaments, the bicomponent filaments not containing the nonionic surfactant did not undergo any substantive crimping when contacted with air during drawing. The filaments also produced flat webs.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A process for forming a nonwoven web comprising the steps of:

melt spinning multicomponent filaments, said filaments comprising a first polymeric component and a second polymeric component, said first polymeric component having a faster solidification rate than said second polymeric component, said first polymeric component containing a crimp enhancement additive, said crimp enhancement additive comprising a nonionic surfactant;

drawing said multicomponent filaments;

naturally crimping said multicomponent filaments; and thereafter forming said multicomponent filaments into a nonwoven web.

2. A process as defined in claim 1, wherein said nonionic surfactant comprises an ether of a fatty alcohol.

3. A process as defined in claim 1, wherein said nonionic surfactant comprises an alkyl ether alkoxylate.

4. A process as defined in claim 1, wherein said nonionic surfactant comprises a siloxane alkoxylate.

5. A process as defined in claim 1, wherein said nonionic surfactant comprises an ester of a polyalkylene glycol.

6. A process as defined in claim 1, wherein said nonionic surfactant comprises a mixture of a glycerol ester and a polysaccharide derivative.

7. A process as defined in claim 6, wherein said glycerol ester comprises an alkoxylated castor oil and said polysaccharide derivative comprises sorbitan monooleate.

8. A process as defined in claim 1, wherein said first polymeric component comprises polypropylene and said second polymeric component comprises polypropylene.

9. A process as defined in claim 1, wherein said first polymeric component comprises polypropylene and said second polymeric component comprises polyethylene.

10. A process as defined in claim 1, wherein said nonionic surfactant is added to said first polymeric component in an amount up to about 5% by weight.

11. A process for forming a nonwoven web comprising the steps of:

melt spinning bicomponent filaments, said bicomponent filaments comprising a first polymeric component and a second polymeric component, said first polymeric component comprising polypropylene blended with a crimp enhancement additive, said crimp enhancement additive comprising a nonionic surfactant, said second polymeric component comprising a material selected from the group consisting of polypropylene and polyethylene;

drawing said bicomponent filaments;

crimping said bicomponent filaments; and thereafter forming said bicomponent filaments into a nonwoven web.

12. A process as defined in claim 11, wherein said nonionic surfactant comprises a material selected from the group consisting of an alkyl ether alkoxylate, a siloxane alkoxylate, an ester of a polyalkylene glycol, a glycerol ester, a polysaccharide derivative, and mixtures thereof.

13. A process as defined in claim 11, wherein said nonionic surfactant comprises polyethylene glycol monolaurete.

14. A process as defined in claim 11, wherein said nonionic surfactant comprises a mixture of sorbitan monooleate and an alkoxylated castor oil.

15. A process as defined in claim 11, wherein said nonionic surfactant is present within said first polymeric component in an amount from about 0.5% to about 5% by weight.

16. A process as defined in claim 11, wherein said nonionic surfactant is present within said first polymeric component in an amount from about 1.5% to about 3.5% by weight.

17. A process as defined in claim 11, wherein said crimped bicomponent filaments contain at least 10 crimps per inch.

18. A nonwoven web comprising spunbond multicomponent crimped filaments, said multicomponent crimped filaments being made from at least a first polymeric component and a second polymeric component, said first polymeric component having a faster solidification rate than said second polymeric component, said first polymeric component containing a crimp enhancement additive, said crimp enhancement additive comprising a nonionic surfactant.

19. A nonwoven web as defined in claim 18, wherein said nonionic surfactant comprises a material selected from the group consisting of an alkyl ether alkoxylate, a siloxane alkoxylate, an ester of a polyalkylene glycol, a glycerol ester, a polysaccharide derivative, and mixtures thereof.

20. A nonwoven web as defined in claim 18, wherein said spunbond multicomponent filaments are crimped naturally.

21. A nonwoven web as defined in claim 18, wherein said first polymeric component comprises polypropylene and said second polymeric component comprises a material selected from the group consisting of polypropylene and polyethylene.

22. A nonwoven web as defined in claim 18, wherein said nonionic surfactant is present in said first polymeric component in an amount from about 0.5% to about 5% by weight.

23. A nonwoven web comprising spunbond multicomponent crimped filaments, said multicomponent crimped filaments including at least a first polymeric component and a second polymeric component, said first polymeric component comprising polypropylene blended with a crimp enhancement additive, said crimp enhancement additive comprising a material selected from the group consisting of an alkyl ether alkoxylate, a siloxane alkoxylate, an ester of a polyalkylene glycol, a glycerol ester, a polysaccharide derivative, and mixtures thereof, said second polymeric component comprising a material selected from the group consisting of polypropylene and polyethylene.

24. A nonwoven web as defined in claim 23, wherein said crimp enhancement additive is present in said first polymeric component in an amount from about 0.5% to about 5% by weight.

25. A nonwoven web as defined in claim 23, wherein said crimp enhancement additive comprises an alkyl ether alkoxylate.

26. A nonwoven web as defined in claim 23, wherein said crimp enhancement additive comprises a siloxane alkoxylate.

27. A nonwoven web as defined in claim 23, wherein said crimp enhancement additive comprises a mixture of sorbitan monooleate and an alkoxylated castor oil.

28. A nonwoven web as defined in claim 23, wherein said web has a basis weight of from about 0.5 ounces per square yard to about 5 ounces per square yard, has a density of from about 0.02 grams per cubic centimeter to about 0.03 grams per cubic centimeter, and wherein said multicomponent filaments have a denier of less than 5 and have at least 10 crimps per inch.

29. A naturally crimped bicomponent filament comprising at least a first polymeric component and a second polymeric component, said first polymeric component comprising polypropylene blended with a crimp enhancement additive, said crimp enhancement additive comprising a nonionic surfactant, said second polymeric component comprising a material selected from the group consisting of polypropylene and polyethylene, said multicomponent filament having a denier of less than about 5 and having at least 10 crimps per inch.

30. A naturally crimped bicomponent filament as defined in claim 29, wherein said nonionic surfactant comprises a material selected from the group consisting of an alkyl ether alkoxylate, a siloxane alkoxylate, an ester of a polyalkylene glycol, a glycerol ester, a polysaccharide derivative, and mixtures thereof.

* * * * *

UNITED STATES PATENT AND TRADEMARK OFFICE

CERTIFICATE OF CORRECTION

PATENT NO. : 5,876,840
DATED : March 2, 1999
INVENTOR(S) : Xin Ning and Samuel E. Marmon It is certified that error appears in the above-identified patent and that said Letters Patent is hereby corrected as shown below:

Column 3,
Line 46, "crimps per inch of particular advantage" should read -- crimps per inch. Of particular advantage, --.

Column 8,
Line 34, "No. 5,382,400 to Pike et al.," should read -- No. 5,382,400 to Pike et al., --.

Column 9,
Line 43, "component A preferably" should read -- component A preferably --.

Column 11,
Line 60, "pike et al." should read -- Pike et al. --.

Signed and Sealed this

Ninth Day of May, 2006

JON W. DUDAS
*Director of the United States Patent and Trademark Office*